US008085212B2

(12) United States Patent
Legay et al.

(10) Patent No.: US 8,085,212 B2
(45) Date of Patent: Dec. 27, 2011

(54) RECONFIGURABLE RADIANT ARRAY ANTENNA

(75) Inventors: Hervé Legay, Plaisance/du/Touch (FR); Michel Soudet, Lacroix/Falgarde (FR); Eric Labiole, Villeneuve/Tolosane (FR)

(73) Assignee: Thales (FR)

( * ) Notice: Subject to any disclaimer, the term of this patent is extended or adjusted under 35 U.S.C. 154(b) by 302 days.

(21) Appl. No.: 12/521,183

(22) PCT Filed: Dec. 21, 2007

(86) PCT No.: PCT/EP2007/064414

§ 371 (c)(1), (2), (4) Date: Oct. 9, 2009

(87) PCT Pub. No.: WO2008/080894

PCT Pub. Date: Jul. 10, 2008

(65) Prior Publication Data

US 2010/0097290 A1 Apr. 22, 2010

(30) Foreign Application Priority Data

Dec. 27, 2006 (FR) ..... 06 55975

(51) Int. Cl.
*H01Q 3/00* (2006.01)

(52) U.S. Cl. ..... 343/766; 343/754; 343/757; 343/781 P

(58) Field of Classification Search ..... 343/754, 343/755, 757, 766, 781 P, 836, 837
See application file for complete search history.

(56) References Cited

U.S. PATENT DOCUMENTS

| | | | | |
|---|---|---|---|---|
| 3,040,310 | A * | 6/1962 | Hausz | 342/80 |
| 6,023,247 | A * | 2/2000 | Rodeffer | 343/765 |
| 6,919,852 | B2 * | 7/2005 | Desargant et al. | 343/766 |
| 7,492,322 | B2 * | 2/2009 | Jung et al. | 343/757 |
| 7,629,935 | B2 * | 12/2009 | Mansour et al. | 343/757 |
| 7,636,068 | B2 * | 12/2009 | Duk-Yong | 343/766 |
| 2007/0268192 | A1 | 11/2007 | Legay et al. | |

FOREIGN PATENT DOCUMENTS

| | | |
|---|---|---|
| FR | 2 655 453 A1 | 6/1991 |
| FR | 2 874 749 A1 | 3/2006 |

OTHER PUBLICATIONS

Herve Legay et al., "A Steerable Reflectarray Antenna with MEMS Controls", Phased Array Systems and Technology—IEEE International Symposium, Oct. 14-17, 2003, pp. 494-499.

* cited by examiner

*Primary Examiner* — Tho G Phan
(74) *Attorney, Agent, or Firm* — Baker & Hostetler, LLP

(57) ABSTRACT

The invention relates to a reconfigurable reflecting array antenna comprising a subset of patterns capable of radiating signals emitted in a given direction and means of loading and placing said radiating arrays to place one of them in a chosen emitting position, characterized in that:

the loading and placement means comprise a system for scrolling a first film ($F_1$) comprising the subsets of radiating patterns used to selectively position a subset of radiating patterns in the emitting position.

The antenna can be of the reflecting array antenna type or of the phased array antenna type.

16 Claims, 6 Drawing Sheets

RECONFIGURABLE RADIANT ARRAY ANTENNA

CROSS-REFERENCE TO RELATED APPLICATIONS

This application is a national stage of International Application No. PCT/EP2007/064414, filed Dec. 21, 2007, which claims priority to foreign French Application No. FR 0655975, filed Dec. 27, 2006, the disclosure of each application is hereby incorporated by reference in their entirety.

FIELD OF THE INVENTION

The field of the invention is that of onboard array antennas, for example on satellites, of the reflecting array antenna type (also commonly referred to as "reflect array antennas") or phased array antennas.

BACKGROUND OF THE INVENTION

The expression "reflecting array antenna" should be understood here to mean an antenna comprising radiating elements, also called phase-shifting cells, defining a reflecting array and responsible for intercepting with minimal losses waves comprising signals to be transmitted, delivered by an antenna feed, in order to reflect them in a chosen direction, called pointing direction.

The abovementioned array antennas are interesting in that they make it possible to misalign a radiating beam toward a given coverage area (or "spot") or to form the beam so that it hugs a geographic contour. To move from one coverage area to another, it is then necessary to reconfigure the radiation of each phase-shifting cell, by providing it with phase-control devices. These phase controls can be implemented by providing the radiating elements with controllable components (diodes, MEMS), in which case the array is an active reflecting array, or by modifying the physical form of the radiating element, in which case the array is a passive reflecting array.

The active reflecting array makes it possible to provide coverage that can be reconfigured but at the cost of significant complexity; the passive reflecting array is mainly attractive for its simple planar geometry.

It is also possible to carry out missions that can be reconfigured in flight using passive reflecting arrays, through the interchangeability of the reflecting arrays in front of the feed of an antenna. This means loading onboard as many reflecting arrays as there are coverages envisaged, bearing in mind that each reflecting array consists of an assembly comprising a support with reflecting patterns that are normally etched, a spacer and a ground plane, although the latter two elements are not specific to the coverage, the spacer typically being able to be a "honeycomb" structure.

More specifically, the solutions currently available consist in storing several reflecting arrays in the form of panel assemblies stacked one on top of the other and positioning them in succession in flight in front of the feed according to the coverage requirements. However, their drawbacks include:

- A significant volume notably on the earth side generated by the size of the reflecting arrays stored alongside or under the reflecting array during operation.
- A number of coverages that is limited by the bulk of the reflecting arrays to be placed onboard (four or five elements).
- A stacking structure of a size related to the bulk volume of the group of reflecting arrays.

- For the equipment in the vicinity of the antenna and for the antenna itself, RF and thermal fields of view able to be reduced by the presence of the stored reflecting arrays.

SUMMARY OF THE INVENTION

In this context, and to resolve the abovementioned problems, the present invention proposes a device for storing the radiating arrays in a compact volume and notably for storing the substrates bearing the radiating patterns in means that can easily be deployed in space. It thus enables the use of a large number of radiating arrays in a reduced volume and weight compared to a concept that uses as many rigid panel radiating arrays and the interchangeability in flight of the coverages of an antenna by changing the radiating array according to the requirements.

More specifically, the subject of the invention is a reconfigurable array antenna suitable for delivering signals in wave form, comprising a set of radiating arrays, each radiating array comprising a subset of patterns capable of reflecting or emitting the signals in a given direction and means of loading and placing said radiating arrays to place one of them in a selected emitting position, characterized in that:

- the loading and placement means comprise a system for scrolling a first film comprising the subsets of radiating patterns making it possible to selectively position a subset of radiating patterns.

According to a variant of the invention, the reconfigurable array antenna comprises a feed suitable for delivering signals in wave form, the loading and placement means being used to selectively position a subset of radiating patterns facing the feed.

According to a variant of the invention, the reconfigurable array antenna comprises a beam-forming splitter feeding the radiating elements so as to form a direct radiation-type antenna.

According to a variant of the invention, the radiating patterns may be coupled to controllable-phase control devices that can be of diode or MEMS type.

According to a variant of the invention, the system for scrolling the film of radiating patterns comprises a first motorized drum and a second drum with a permanent return moment.

According to a variant of the invention, the radiating arrays also comprise a ground plane and a spacer.

According to a variant of the invention, the scrolling system also comprises spacing rollers, fixed to a ground plane and used to scroll the film of radiating patterns at a fixed distance from said ground plane so as to impose a space between said film and said ground plane. The film can thus be stored by winding. It is then sufficient to position it by unwinding in front of a unique ground plane in order for it to be operational, making it possible to position a chosen radiating array facing the feed.

According to a variant of the invention, the film is positioned on a support whose distance from the film bearing the radiating patterns can be adjusted.

According to a variant of the invention, the first film comprises, on one and the same face, first constituent portions of the radiating patterns and second constituent portions of the ground planes. An appropriate unwinding operation makes it possible to position a first portion of film and a second portion in a facing position so as to constitute the following assembly: radiating patterns/spacer consisting of air/a ground plane.

According to a variant of the invention, the first film comprises on one of its faces the radiating patterns and on the other face the ground plane.

According to a variant of the invention, the antenna comprises: a motorized drum, an armature and means of deploying said film on the surface of the armature.

According to a variant of the invention, the deployment means comprise a film unwinder, and a cable used to draw the film from the unwinder, said cable being driven by a drum.

According to a variant of the invention, the deployment means comprise pulleys to handle the scrolling of said film.

According to a variant of the invention, the reconfigurable array antenna also comprises means of scrolling a second film.

According to a variant of the invention, the antenna also comprises an armature having a first face and a second face and means of deploying the first film on said first face and the second film on said second face so as to place a selected area of said first film and a selected area of said second film in a facing position.

According to a variant of the invention, the means of deploying said films comprise a first unwinder for the first film, a second unwinder for the second film and two cables used to draw said films, said cables being driven by a drum.

According to a variant of the invention, the deployment means comprise pulleys to handle the scrolling of said films.

According to a variant of the invention, the antenna comprises a sensor used to read position information etched on an edge of the first and/or the second film.

According to a variant of the invention, the reconfigurable array antenna comprises a set of armatures making it possible to deploy, in parallel and in one and the same plane, several films comprising the subsets of radiating patterns, making it possible to selectively position a subset of radiating patterns facing the feed.

BRIEF DESCRIPTION OF THE DRAWINGS

The invention will be better understood and other benefits will become apparent from reading the description that follows, given by way of nonlimiting example, and from the appended figures in which.

DETAILED DESCRIPTION

The inventive reconfigurable reflecting array antenna can be placed onboard a Ku band (12 to 18 GHz) telecommunications geostationary satellite. However, the invention is not limited to that application. It relates in effect to radar antennas placed onboard satellites, possibly flying in formation, or on airplanes or spacecraft, such as shuttles. Thus, the invention is well suited to SAR antennas [synthetic apperture radar antennas, operating in the C band (4 to 8 GHz) or X band (8 to 12 GHz)].

Figure 1A:
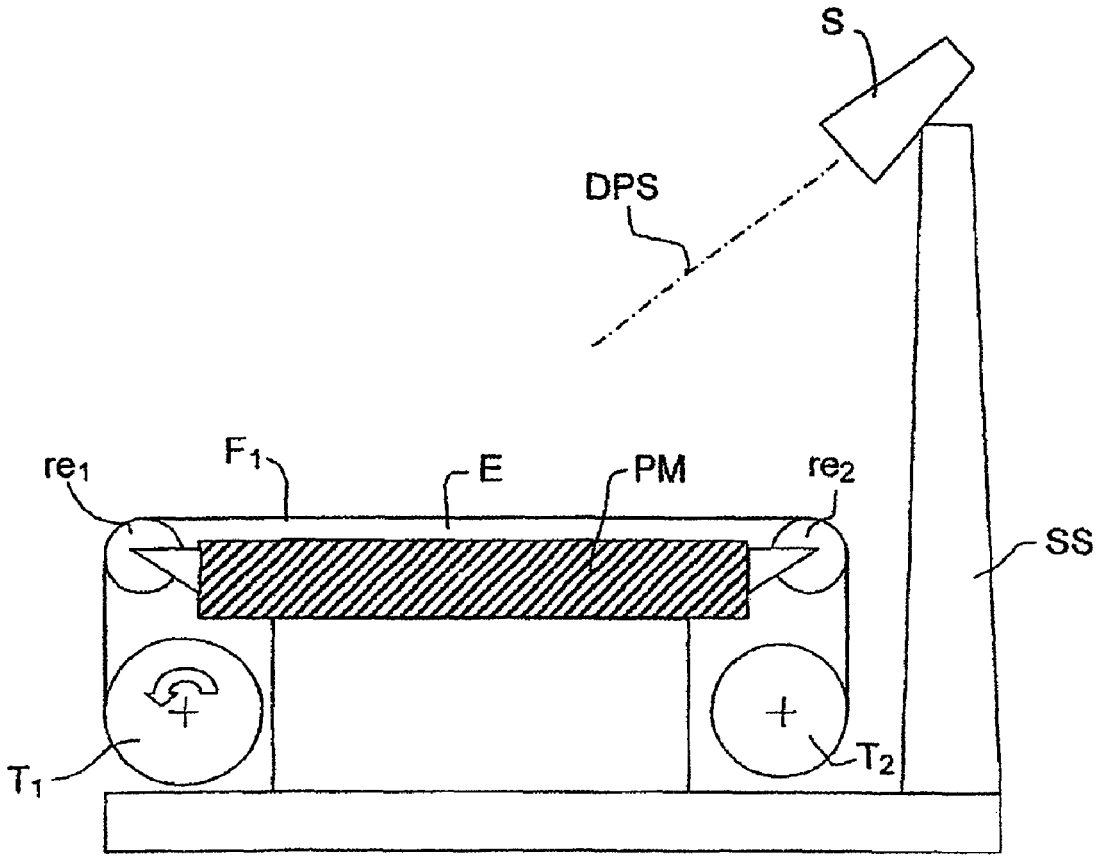
FIG. 1*a* illustrates a cross-sectional view of a first variant of an antenna according to the invention including the scrolling of a film comprising the radiating patterns.
Figure 1B:
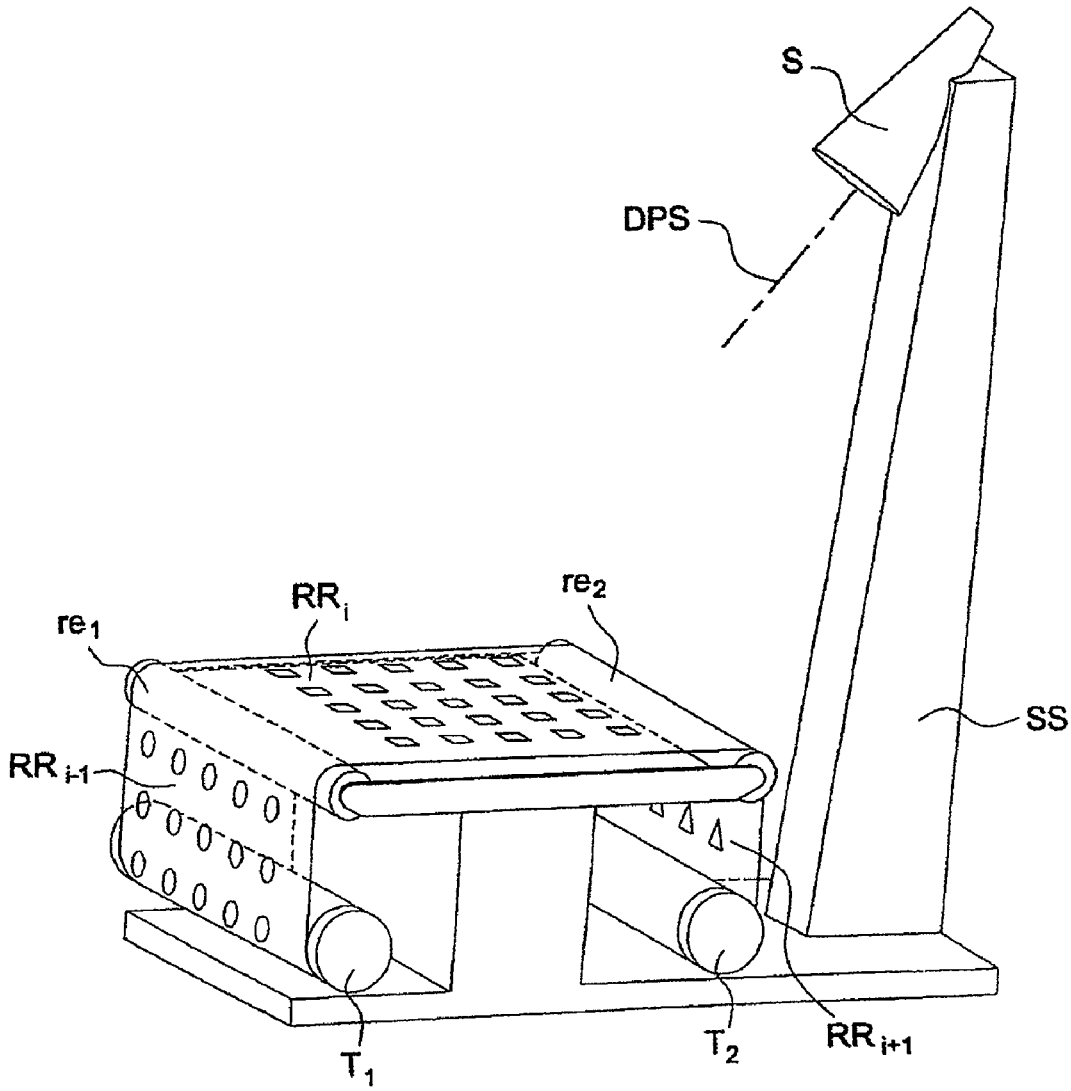
FIG. 1*b* illustrates a perspective view relating to the first variant of the invention.

In a first exemplary embodiment illustrated in FIGS. 1*a* and 1*b*, which respectively represent a cross-sectional view and a perspective view, the array antenna is an antenna of the reflecting array antenna type and comprises a support structure SS suitable to be attached to a satellite (not represented) and on which is first of all fixed, in a chosen location, an antenna feed S for delivering, at a chosen solid angle of primary direction DPS, called feed pointing direction, waves comprising the signals to be transmitted. The feed is, for example, implemented in the form of a horn, the radiating elements are reflectors capable of reflecting the waves comprising the signals to be transmitted.

The antenna also comprises a system for deploying a film $F_1$ carrying different subsets of reflecting patterns constituting reflecting arrays, in relation to a fixed ground plane, while maintaining a spacer between said reflecting arrays and the ground plane. The solution consists in arranging the arrays, each comprising a set of reflecting patterns, one after the other on a thin film. More specifically, the film is wound onto two drums $T_1$ and $T_2$. The rotation of the drums scrolls the film in front of a ground plane PM, from which it is separated by a constant distance maintained by two spacing rollers $re_1$ and $re_2$ positioned relative to the ground plane. The space E (in this case the vacuum) between the film and the ground plane replaces the spacer of the reflecting array.

The film is held flat under a tension force generated by a moment acting permanently on the drum $T_1$ on which it is wound. This moment can be generated by a torsion spring located inside the drum, or any other device. The variations of thermo-elastic type are thus permanently compensated, which maintains the flatness of the substrate.

The subset of reflecting patterns is changed by winding the film onto the drum $T_2$ until the required pattern is positioned in front of the ground plane and facing the feed. A motorization on the drum $T_2$ associated with a position sensor is used to position and control it. These functions can be obtained by a stepper motor and a reducer, geared for example, located in the drum $T_2$, associated with a sensor reading position information etched on the edge of the film, or any other device enabling these functions.

Depending on the direction of rotation of the drum $T_2$, this film scrolls in one direction or the other and is kept wound on the two drums by the action of the permanent moment acting on the drum $T_1$. The movements of the unwinder and of the drum can also be obtained by a common motorization (driven by synchronous pulley gear for example), in which case a torsion spring must make the link between the external portion of the unwinder and its axis in order to ensure the permanent moment whatever the state of winding of the film.

As is known, the film comprises a reflecting array RRi highlighted in FIG. 1*b* and selectively positioned facing the feed (whereas the adjacent arrays $RR_{i-1}$ and $RR_{i+1}$ are represented as not being operational), each reflecting array comprises a number of phase-shifting cells capable of imposing on the waves (delivered by the feed) a phase shift with a chosen frequency phase dispersion, in order to reflect them in a chosen direction. The chosen phase shift and/or the chosen frequency phase dispersion varies/vary from one reflecting array RRi to another, provided that the coverage area (or "spot") of the beam from the antenna, and/or the shape of this area, varies/vary as a function of the selected reflecting array RRi.

During the dynamic phase of the launch, the mobile assembly must be immobilized by a stacking device of known type.

After deployment in space, the low weight and the small bulk of the film carrying the reflecting patterns wound on the drums make it possible to have an antenna offering a large number of coverages in a compact assembly.

Advantageously, the ground plane is unique for all the coverages, which avoids any added payload and the spacer is replaced by vacuum which favors the RF performance characteristics of the reflecting array antenna.

Figure 2A:
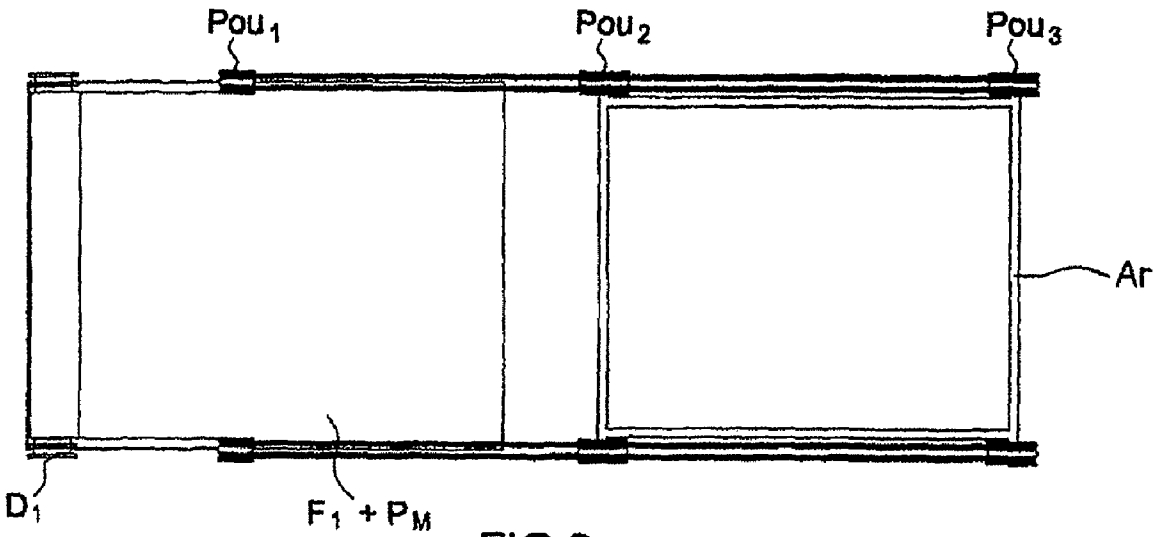
FIG. 2*a* illustrates a plan view of a second variant of an antenna according to the invention in which the first film also carries a ground plane.
Figure 2B:
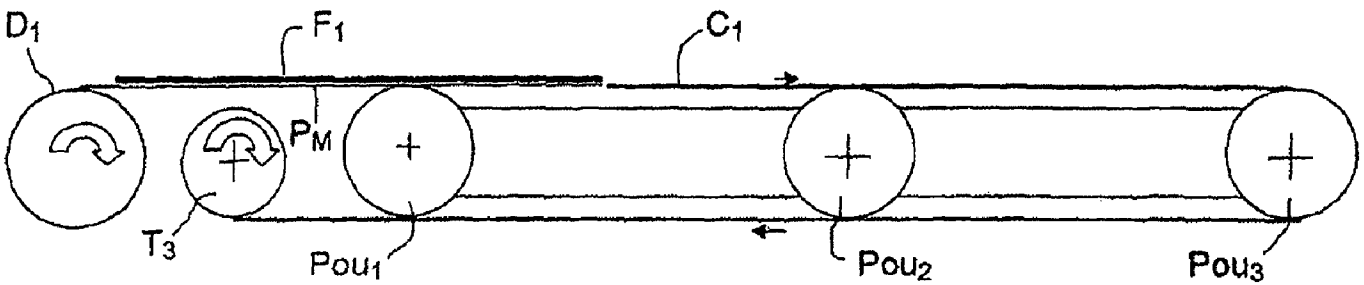
FIG. 2*b* illustrates a cross-sectional view of the second variant of the invention.

According to a second variant of the invention that is particularly advantageous when seeking to deploy several antenna elements in space, the first film can carry the ground plane and the antenna can advantageously comprise a single motorized drum associated with an armature on which the reflecting array/spacer/ground plane assembly can be made to scroll, the armature comprising a set of pulleys to enable such scrolling. FIGS. 2*a* and 2*b* diagrammatically illustrate this exemplary configuration. FIG. 2*a* illustrates a plan view of the armature Ar comprising a set of pulleys $Pou_l$, $Pou_2$, $Pou_3$, on which, thanks to a cable $C_1$, a single film carrying the reflecting array/spacer/ground plane assembly $F_1$+PM is deployed, from an unwinder $D_1$. FIG. 2*b* illustrates a cross-sectional view highlighting the system for scrolling the film comprising on its so-called top face the reflecting patterns and on its bottom face the ground plane, on the armature. The film obtained from the unwinder $D_1$ is drawn via the cable $C_1$ by the motorized drum $T_3$, the cable and the film thus being driven above the pulleys.

Figure 3A:
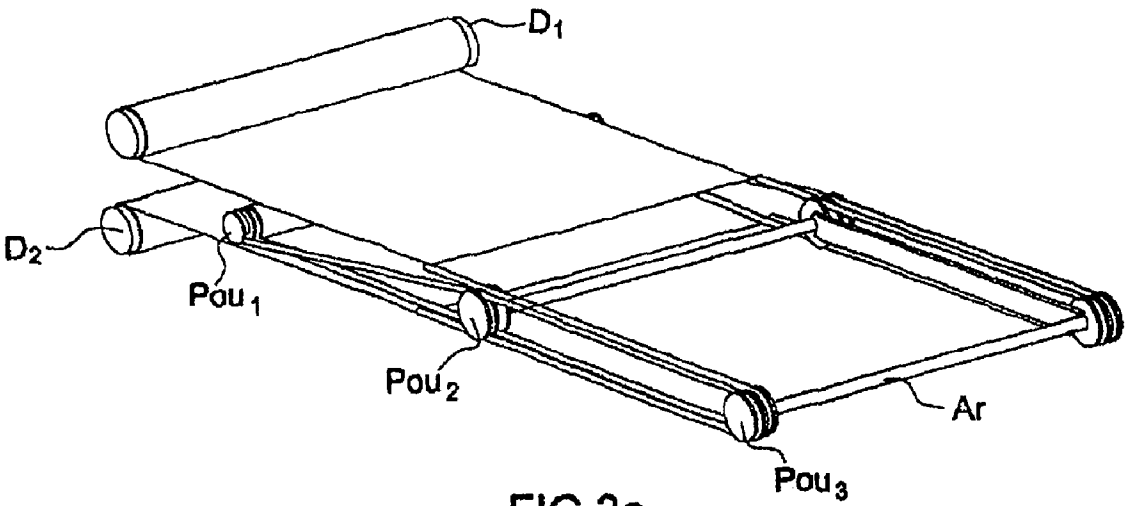
FIG. 3*a* illustrates a plan and perspective view of a third variant of an antenna according to the invention in which two scrolling films are used.
Figure 3B:
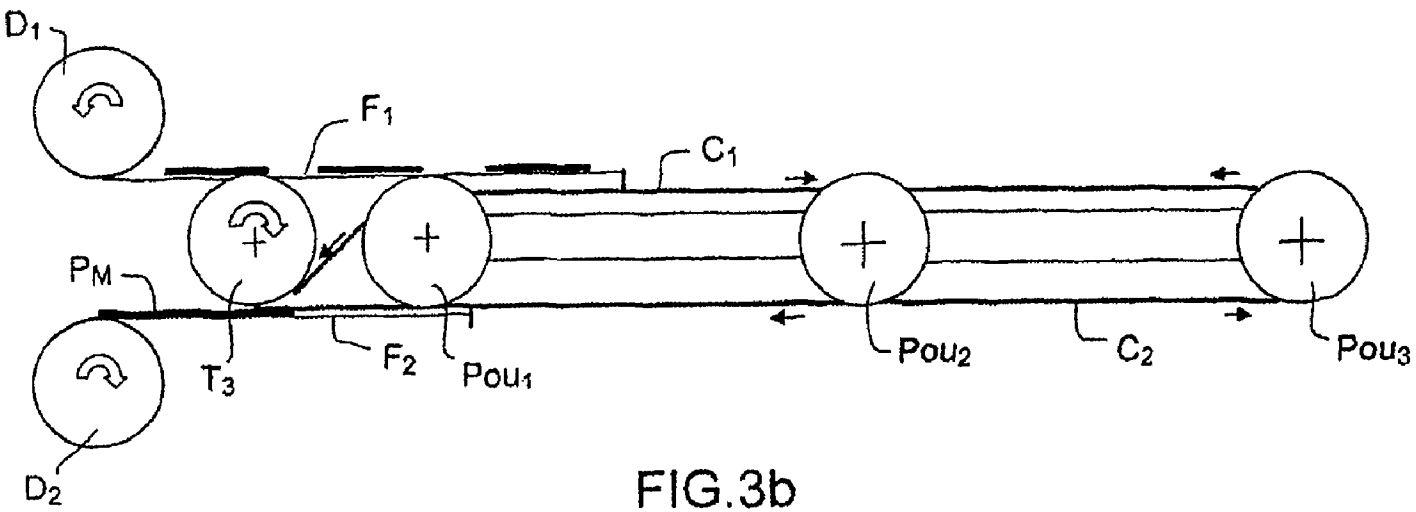
FIG. 3*b* illustrates a cross-sectional view of the third variant of the invention.

According to a third variant of the invention, the antenna comprises both a first film $F_1$ comprising the subsets of reflecting patterns stored on a first unwinder $D_1$ and a second film $F_2$ constituting the ground plane stored on a second unwinder $D_2$. FIGS. 3*a* and 3*b* illustrate this variant in which a single drum $T_3$ can advantageously be used to simultaneously deploy the two films with a single motorization associated with a set of two cables $C_1$ and $C_2$ and transmissions by three pulleys $Pou_l$, $Pou_2$, $Pou_3$.

Figure 4A:
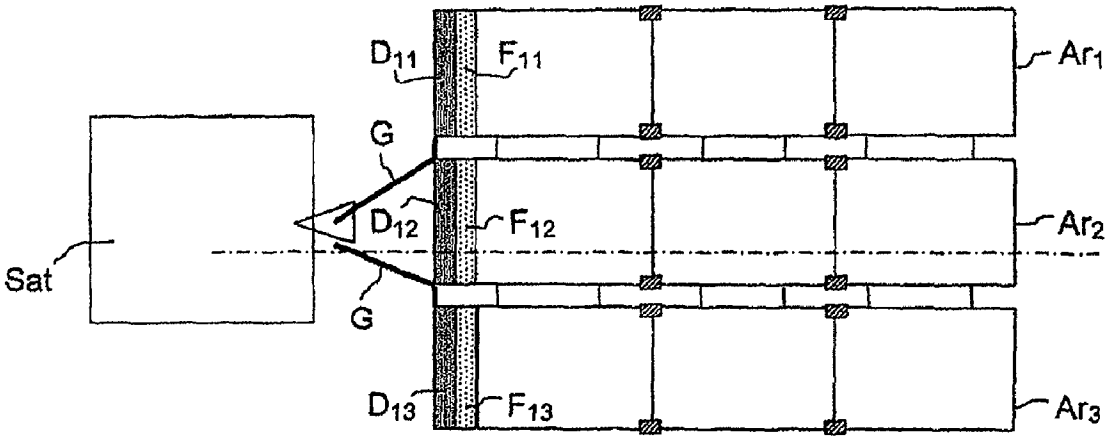
FIG. 4*a* illustrates a plan view of a variant of an antenna according to the invention comprising several armatures used to deploy a matrix of reflecting arrays.
Figure 4B:
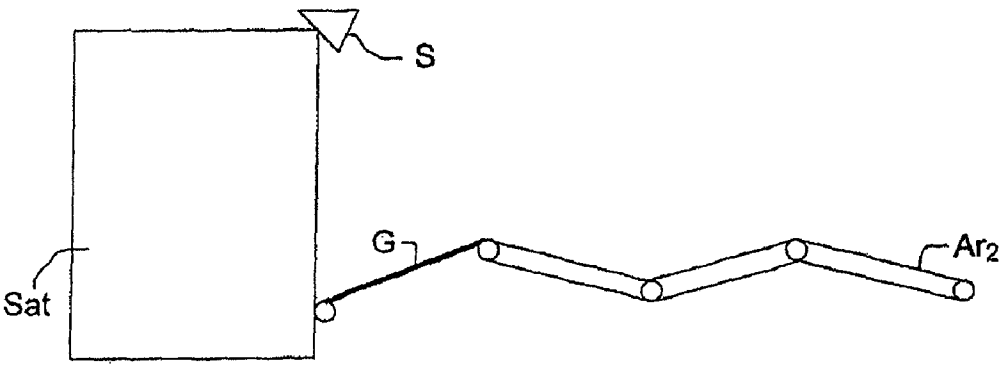
FIG. 4*b* illustrates a cross-sectional view of the variant illustrated in FIG. 4*a;*

Advantageously, to multiply the number of reflecting arrays, it is possible to produce a matrix of elements such as those shown in the variants 2 or 3. FIG. 4*a* illustrates a plan view of an antenna according to the invention onboard a satellite Sat and represented in the deployed position, highlighting three armatures $Ar_1$, $Ar_2$, $Ar_3$, coupled with three unwinders $D_{11}$, $D_{12}$, $D_{13}$, the reflecting arrays being on films that are shown not unwound $F_{11}$, $F_{12}$, $F_{13}$. The armatures are deployed from a stacking element G, the position of the feed S being adjustable to be incident with respect to a chosen reflecting panel. FIG. 4*b* illustrates this same antenna seen in cross section and highlighting the armature $Ar_2$.

According to the invention, it becomes possible to place onboard an antenna that is compact and capable of producing a large number of different coverages using the principle of flat reflecting arrays. The RF performance characteristics are in addition strengthened by the formation of a vacuum space which constitutes a spacer of excellent dielectric performance characteristics.

Generally, the films are made of a reinforced or non-reinforced dielectric material supporting metallic etchings or from a thin material that reflects the electromagnetic waves. Such materials are, for example, of the ARLON, KAPTON, ROGERS or CUCLAD type, comprising a thin film 50 or 127 micrometers thick. The flexibility of such films makes it possible to obtain, in association with the tension-maintaining devices, the requisite flatnesses, which are, for example, of the order of 200 micrometers RMS for a 1 m×1 m Ku band reflecting array.

According to the invention, it becomes possible to place onboard ten or so sets of reflecting patterns with a surface area of the order of a square meter.

The invention has been described above in the case of a reflecting array type antenna, but is also perfectly applicable to direct radiation array type antennas.

In this case, the splitting of the signal to the radiating elements is no longer done using an illuminating feed. It is done using a beam-forming splitter (also called beam forming network) having an input port and as many output ports as there are radiating elements. The splitter network is preferably of the waveguide type, to reduce the distribution losses. In the case where the radiating elements are of small size, it may be wise to adopt a hybrid approach for the splitter network, combining a waveguide-type technology for routing over long distances, and a planar technology close to the radiating elements to benefit from its compactness.

The radiating elements are of planar technology type. They comprise a ground plane, an excitation mode (aperture in the ground plane, power supplied by coupling, power supplied by probe), and one or more planar patterns (patches, even grid-type etching). The radiating elements are potentially provided with lateral cavities, which increases the decoupling between radiating elements and can assist in their debugging.

The pattern is reconfigured by modifying the phase of the signal radiated by the radiating elements. The procedure may consist in modifying the shape thereof.

However, it is also necessary to adapt the radiating element to the output port of the forming array. Thus, to guarantee both the adaptation and the phase-shifting capability, it is advantageous to provide the radiating element with two levels of radiating patterns. By doing so, the bandwidth of the antenna is also increased.

Figure 5:
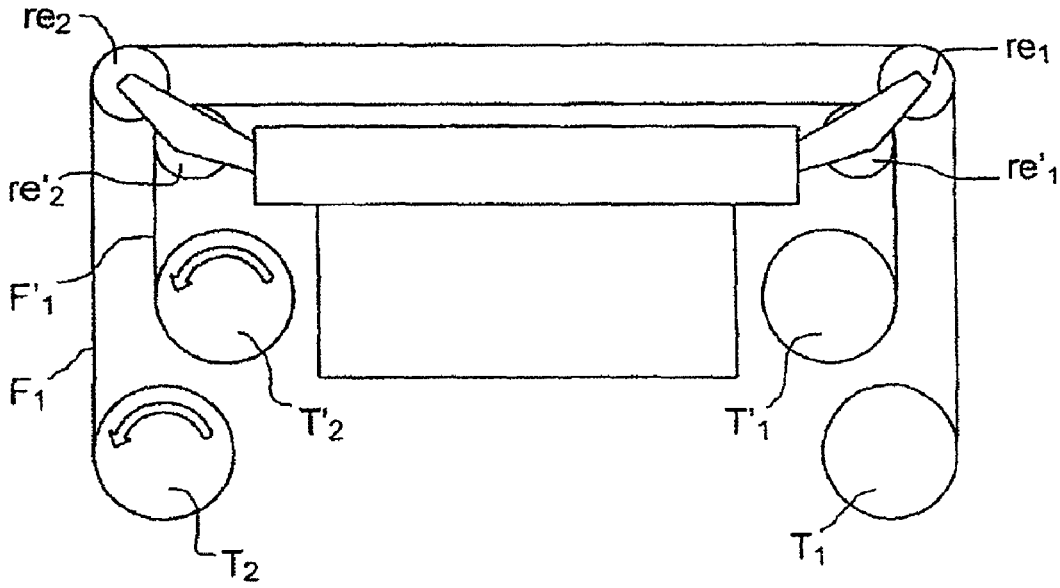
FIG. 5 illustrates a fourth variant of an antenna according to the invention in which the antenna operates in direct radiation array mode.

In this case, the arrays can be produced on two films. FIG. 5 illustrates such a configuration highlighting two films $F_1$ and $F_1$, carrying reflecting patterns. Drums $T_1$, $T_{1'}$, $T_2$, $T_{2'}$ handle the scrolling of said films. The desired spacings are calibrated using spacing rollers $re_1$, $re_{1'}$, $re_2$, $re_{2'}$ positioned relative to a support.

The invention claimed is:

1. A reconfigurable array antenna suitable for delivering signals in wave form, comprising a set of radiating arrays, each array comprising a subset of patterns capable of radiating the signals emitted in a given direction and means of loading and placing said radiating arrays to place one of them in a selected emitting position, wherein:

the loading and placement means comprise a system for scrolling a first film comprising the subsets of radiating patterns used to selectively position a subset of radiating patterns in the emitting position, said system for scrolling the film of radiating patterns comprising a first motorized drum and a second drum with a permanent return moment.

2. The reconfigurable array antenna as claimed in claim 1, further comprising a feed suitable for delivering signals in wave form, the loading and placement means being used to selectively position a subset of radiating patterns facing the feed.

3. The reconfigurable array antenna as claimed in claim 2, wherein the scrolling system also comprises spacing rollers, fixed to a ground plane and used to scroll the film of radiating patterns at a fixed distance from said ground plane so as to impose a space between said film and said ground plane.

4. The reconfigurable array antenna as claimed in claim 3, wherein the first film comprises on one of its faces the radiating patterns and on the other face the ground plane.

5. The reconfigurable array antenna as claimed in claim 4, further comprising:

a motorized drum;

an armature;

means of deploying said film on the surface of the armature.

6. The reconfigurable array antenna as claimed in claim 5, wherein the deployment means comprise a film unwinder, and a cable used to draw the film, said cable being driven by the drum.

7. The reconfigurable array antenna as claimed in claim 6, wherein the deployment means comprise pulleys to handle the scrolling of said film.

8. The reconfigurable reflecting array antenna as claimed in claim 6, further comprising a set of armatures making it possible to deploy, in parallel and in one and the same plane, several films comprising the subsets of radiating patterns.

9. The reconfigurable array antenna as claimed in claim 1, further comprising a beam-forming splitter feeding the radiating elements so as to form a direct radiation-type antenna.

10. The reconfigurable array antenna as claimed in claim 1, wherein the radiating patterns are coupled to controllable-phase control devices that can be of diode or MEMS type.

11. The reconfigurable array antenna as claimed in claim 1, wherein the radiating arrays also comprise a ground plane and a spacer.

12. The reconfigurable reflecting array antenna as claimed in claim 1, further comprising means of scrolling a second film.

13. The reconfigurable array antenna as claimed in claim 12, further comprising an armature having a first face and a second face, means of deploying the first film on said first face and the second film on said second face so as to place a selected area of said first film and a selected area of said second film in a facing position.

14. The reconfigurable reflecting array antenna as claimed in claim 13, wherein the means of deploying said films comprise a first unwinder for the first film, a second unwinder for the second film and two cables used to draw said films, said cables being driven by a drum ($T_3$).

15. The reconfigurable reflecting array antenna as claimed in claim 13, wherein the deployment means comprise pulleys to handle the scrolling of said films.

16. The reconfigurable reflecting array antenna as claimed in claim 1, further comprising a sensor used to read position information etched on an edge of the first and/or the second film.

* * * * *